US009241589B2

(12) United States Patent
Saltzman

(10) Patent No.: US 9,241,589 B2
(45) Date of Patent: Jan. 26, 2016

(54) EXERCISE MAT AND METHOD OF USING SAME

(71) Applicant: Dan Saltzman, Chicago, IL (US)

(72) Inventor: Dan Saltzman, Chicago, IL (US)

( * ) Notice: Subject to any disclaimer, the term of this patent is extended or adjusted under 35 U.S.C. 154(b) by 149 days.

(21) Appl. No.: 13/732,234

(22) Filed: Dec. 31, 2012

(65) Prior Publication Data

US 2013/0180048 A1 Jul. 18, 2013

Related U.S. Application Data

(60) Provisional application No. 61/581,611, filed on Dec. 29, 2011, provisional application No. 61/681,480, filed on Aug. 9, 2012.

(51) Int. Cl.

| | |
|---|---|
| ***A47G 9/06*** | (2006.01) |
| ***A63B 6/00*** | (2006.01) |
| ***A63B 21/00*** | (2006.01) |
| ***A47G 27/02*** | (2006.01) |
| ***A63B 23/035*** | (2006.01) |
| *A63B 23/00* | (2006.01) |

(52) U.S. Cl.

CPC ..... *A47G 27/0237* (2013.01); *A63B 6/00* (2013.01); *A63B 21/00105* (2013.01); *A63B 21/1473* (2013.01); *A63B 23/035* (2013.01); *A63B 23/03516* (2013.01); *A47G 9/062* (2013.01); *A63B 2023/006* (2013.01)

(58) Field of Classification Search

CPC ..... A47G 9/062; A47G 9/06; A63B 21/1473; A63B 21/00105; A63B 6/00; G09B 19/00; G09B 19/02; G09B 23/02; G09B 23/04; G01B 21/02; G01B 21/04; G01B 21/047; G06G 1/00; G06G 1/0005; G06G 1/02

USPC ..... 5/417, 420; 482/23; D6/582; 33/452–456, 1 B, 1 N; 434/198, 199, 434/211–216; 235/61 R, 61 B, 61 G

See application file for complete search history.

(56) References Cited

U.S. PATENT DOCUMENTS

| | | | | | |
|---|---|---|---|---|---|
| 378,257 | A * | 2/1888 | Leschorn | G01B 3/56 | 235/61 GM |
| 570,157 | A * | 10/1896 | Edmiston | G01B 3/56 | 33/456 |
| 647,339 | A * | 4/1900 | Thompson | G01B 3/56 | 235/88 R |
| 1,074,439 | A * | 9/1913 | Kincaid | G01B 3/56 | 235/61 B |
| 1,189,277 | A * | 7/1916 | Martens | G11B 20/00086 | 283/115 |
| 1,679,927 | A * | 8/1928 | Bell | G01B 3/02 | 33/1 K |
| 1,955,392 | A * | 4/1934 | Shimberg | G09B 23/04 | 235/61 GM |
| 2,249,728 | A * | 7/1941 | Cross | G01C 9/12 | 33/283 |
| 2,403,614 | A * | 7/1946 | Ross | G06G 1/14 | 235/61 GM |
| 2,436,352 | A * | 2/1948 | Downs, Jr. | G06G 1/14 | 235/61 B |
| 2,701,096 | A * | 2/1955 | Wattier | G06G 1/14 | 235/61 GM |
| 2,736,491 | A * | 2/1956 | Potter | G06G 1/00 | 235/61 GM |
| 3,014,646 | A * | 12/1961 | Zenith | G06G 1/00 | 235/61 GM |
| 3,083,475 | A * | 4/1963 | Lepoudre | G09B 23/04 | 434/211 |
| 3,128,944 | A * | 4/1964 | Gabriel | G06G 1/00 | 235/61 B |
| 3,137,443 | A * | 6/1964 | Samuelson | C07D 307/20 | 235/61 B |
| 3,191,318 | A * | 6/1965 | Hoffmann | G09B 23/02 | 434/211 |

(Continued)

*Primary Examiner* — Robert G Santos

(57) ABSTRACT

An Exercise Yoga mat and method of use whereby the mat has printed indicia for measuring distance along the surface of the mat while executing yoga exercise positions.

7 Claims, 10 Drawing Sheets

(56) References Cited

U.S. PATENT DOCUMENTS 3,359,653 A * 12/1967 Redfern ..... G09B 23/04 434/215
3,414,190 A * 12/1968 Lemiesz ..... G06G 1/00 235/61 GM
3,461,573 A * 8/1969 Stibal ..... G09B 23/04 434/189
3,556,397 A * 1/1971 Andersen ..... G06G 1/10 235/61 GM
3,610,519 A * 10/1971 Radosavljevic ..... G06G 1/02 235/51
3,660,903 A * 5/1972 Caperton, Jr. ..... A47B 97/00 33/1 K
3,719,806 A * 3/1973 Davidson ..... G06G 1/14 235/61 B
3,797,134 A * 3/1974 Wingerd ..... G09B 23/04 434/216
3,826,021 A * 7/1974 De Andrea ..... G09B 23/04 235/61 GM
3,903,607 A * 9/1975 Easton ..... G06G 1/00 33/453
3,957,199 A * 5/1976 Hunter ..... G01C 21/20 235/61 GM
4,171,573 A * 10/1979 Picciotto ..... G03B 27/582 33/1 B
D267,725 S * 1/1983 Sidrak ..... D10/61
4,369,359 A * 1/1983 Mendoza ..... G06C 3/00 235/89 R
4,435,162 A * 3/1984 Schoenwald ..... G09B 23/04 434/215
4,461,086 A * 7/1984 Segletes ..... B43L 13/18 33/1 B
4,490,921 A * 1/1985 Woods ..... B43L 13/205 33/1 N
4,655,714 A * 4/1987 Djali ..... G09B 23/04 235/61 GM
D317,131 S * 5/1991 Kwan ..... D10/64
5,071,130 A * 12/1991 Shofner ..... A63B 69/3667 473/218
5,282,317 A * 2/1994 Carter ..... A41H 3/06 33/1 B
5,370,538 A * 12/1994 Sidray ..... G09B 23/04 434/188
5,386,654 A * 2/1995 Kroenke ..... B26D 7/20 223/69
5,407,356 A * 4/1995 Sidrak ..... G09B 23/02 434/188
5,636,461 A * 6/1997 Shewmaker ..... D04G 3/02 33/1 K
5,673,490 A * 10/1997 Hill ..... B44D 3/00 33/1 B
D393,499 S * 4/1998 Brown ..... D21/662
6,159,329 A * 12/2000 Tschanz ..... G09F 3/10 156/277
D436,048 S * 1/2001 Chesson ..... D10/64
6,216,354 B1 * 4/2001 Carbone ..... B43L 13/20 33/27.01
D447,965 S * 9/2001 Groiso ..... D10/62
6,343,423 B1 * 2/2002 Hooker ..... G01B 3/56 33/1 SB
D457,373 S * 5/2002 Prinzmetal ..... D6/582
6,387,013 B1 * 5/2002 Marquez ..... 482/23
D473,806 S * 4/2003 Okada ..... D10/71
6,840,439 B1 * 1/2005 Baguley ..... G09B 19/02 235/61 R
6,925,724 B2 * 8/2005 Tandy ..... D05B 97/12 33/1 B
7,108,635 B2 * 9/2006 Howlett-Campanella ..... 482/23
7,465,263 B1 * 12/2008 Conrad et al. ..... 482/148
D584,093 S * 1/2009 Drumm ..... D6/582
7,819,777 B1 * 10/2010 Service ..... 482/23
D632,119 S * 2/2011 Service ..... D6/582
7,926,188 B2 * 4/2011 Thorkelson ..... B43L 9/08 33/1 K
D657,602 S * 4/2012 Service ..... D6/582
D675,259 S * 1/2013 Chang ..... D19/37
D687,099 S * 7/2013 Dilker ..... D19/113
D699,979 S * 2/2014 Tamayo ..... D6/582
D699,980 S * 2/2014 Tamayo ..... D6/589
8,966,681 B2 * 3/2015 Burch ..... A63B 21/1473 482/23
2001/0034288 A1 * 10/2001 Howlett-Campanella ..... 482/23
2002/0098947 A1 * 7/2002 Brown ..... A63B 26/00 482/23
2003/0017915 A1 * 1/2003 Prinzmetal ..... 482/23
2004/0049935 A1 * 3/2004 Tandy ..... D05B 97/12 33/563
2004/0214692 A1 * 10/2004 Koenig ..... 482/23
2004/0229731 A1 * 11/2004 Mitchell ..... 482/23
2009/0211104 A1 * 8/2009 Thorkelson ..... B43L 9/08 33/1 K
2013/0180048 A1 * 7/2013 Saltzman ..... 5/417
2014/0237718 A1 * 8/2014 Burch ..... 5/417

* cited by examiner (VIEW A OF FIG.1A)

(VIEW B OF FIG.1A)

VIEW C OF FIG.6

VIEW D OF FIG.6

VIEW E OF FIG.6

EXERCISE MAT AND METHOD OF USING SAME

INDEX TO RELATED APPLICATIONS

This application claims benefit to and is a non-provisional application of U.S. Provisional Patent Application No. 61/581,611, filed Dec. 29, 2011 and U.S. Provisional Patent Application No. 61/681,480 filed Aug. 9, 2012, the disclosures of which are both incorporated herein by reference in their entirety.

BACKGROUND OF THE INVENTION

The present invention relates to an Exercise Yoga mat that includes a design on the Exercise Yoga mat that helps the yoga practitioner to properly measure body placement during postures. Until this invention, Exercise Yoga mats are either entirely blank or have lines and designs printed to aid the practitioner with placement. However, none of these give the user the tools to identify the measured distances they are performing poses in.

Yoga has many poses that require a persons contact point foundation to have one or both feet and/or hands on the mat. If the foundation for a particular pose entails at least 2 contact points, this invention allows one to measure the distances between them. By knowing the distances of body placement, one can identify which distances are comfortable, stay consistent from practice to practice, and keep track of progress. In addition, it would be very simple for a teacher to aid the practitioner by identifying to them which spot and what exact distances to perform a pose in. People come in varying sizes and flexibility abilities, lines and designs on one mat may not be entirely suitable for each varying person using that mat. This mat with measurements allows all varieties of people and skill level to find their comfortable positions on the mat, and measure the distances they have performed. For instance, if a shorter person can only stretch out 8 inches, a taller person may be able to measure 12 inches out. Or a shorter person with good flexibility may be able to measure out 12 inches as well. This mat will show exactly how far out one can stretch, irregardless of size and flexibility ability.

FIELD OF THE INVENTION

The invention is in the exercise/yoga mat field and performing exercises within.

SUMMARY OF THE INVENTION

The present invention is a yoga/exercise mat that allows a practitioner to numerically measure ones poses and track his or her flexibility progress during the Exercise Yoga practice. The distance markings can be along the outer edges of the mat, and/or at each spot on the mat.

Two spots on the mat are ideal to be used as starting points for measurements. One can choose a corner to start from, or one can start from the center of the mat. Each spot on the mat has a linear direct distance associated with it from this start point, a horizontal distance from the start point associated with it and a vertical distance from the start point associated with it. For purposes of description, we will call the combination of the horizontal and vertical distances associated with a spot as its 'coordinates'. In a preferred embodiment it is easiest to place these markings/coordinates at one-inch intervals along the mat on a continuous horizontal and vertical plane.

By having spots on the mat that identify distances, one can place any 2 body extremities on the mat and now measure the distances between them. This is essential for tracking, improving, consistency.

In one embodiment, the invention includes a method of performing yoga exercises comprising:

providing a yoga mat having an upper planar surface, a lower planer surface, a series of printed indicia on at least one of the planar surfaces constructed and arranged to measure varying distances along the upper planar surface of said yoga mat;

positioning a user on said upper planer surface, executing a yoga position by said user; and measuring at least one distance of a user's hand or foot relative to one or more of other users hands and feet or to other marked indicia on the mat.

The method in one embodiment is on a mat that is free of grid lines. In another embodiment, the mat has grid lines connecting the measuring spots.

The method includes providing the mat as being labeled with distance indicia.

In another embodiment, the invention is a method of performing yoga exercises comprising:

providing a yoga mat having an upper planar surface, a lower planar surface and a center point, printed indicia denoting said center point, a series of printed indicia constructed and arranged to measure linear distance from said center point along either planar surface of said yoga mat;

positioning a user on said center point;

executing a yoga position by said user; and measuring at least one distance of a user's hand or foot from at least one of a center point, a perpendicular point along the center horizontal midpoint line of mat, a perpendicular point along the vertical midpoint line of mat, or any combination thereof providing at least one of linear, horizontal, vertical measurements to at least one of a user's hand or foot when the hand or foot is placed on the mat. As used herein, surface, is either planer surface of the mat. The surface is generally viewed as the side facing upwards during yoga or exercise use. In one embodiment, the surfaces have different indicia that provide different measurements and indicators for varying yoga exercises.

The method includes one embodiment whereby the printed indicia is connected using grid lines and one embodiment wherein the indicia is free of grid lines.

The method includes providing the mat with printed indicia that includes points equidistantly spaced from said center point.

In one embodiment, the mat is divided into four quadrants. that are identically labeled with distance indicia.

The printed indicia includes points equidistantly spaced from either a center point or a starting point, the starting point, as used herein, being a point on the mat other than the center point, said indicia providing horizontal and vertical distance from said perpendicular points along the vertical or horizontal midpoints of the mat.

The printed indicia includes points equidistantly spaced from the center point or starting point, said indicia providing horizontal and vertical distance from said center point The invention further provides a yoga mat comprising: an upper planer surface, a lower planer surface and a center point, or a starting point, the starting point being a point on the mat other than the center point, wherein printed indicia denotes at least one of a center point or staring point, a series of printed indicia constructed and arranged to measure linear distance from said center point along the upper planer surface of said yoga mat.

In one embodiment, the mat is free of grid lines.

The printed indicia includes points or spots that are equidistantly spaced from center point or starting point. The yoga mat is preferably divided into four quadrants that are identically labeled with distance indicia. The printed indicia includes points equidistantly spaced from center point or starting point, said indicia providing horizontal and vertical distance from said center point.

The printed indicia includes points equidistantly spaced from said center point or starting point and said indicia provides visual indication for a user to determine horizontal and vertical distance from said center point.

In a preferred embodiment that will be detailed and focused on more thoroughly has the measurements starting from a center point on the mat and working outward in 4 directions.

DETAILED DESCRIPTION OF THE PREFERRED EMBODIMENT

Figure 5:
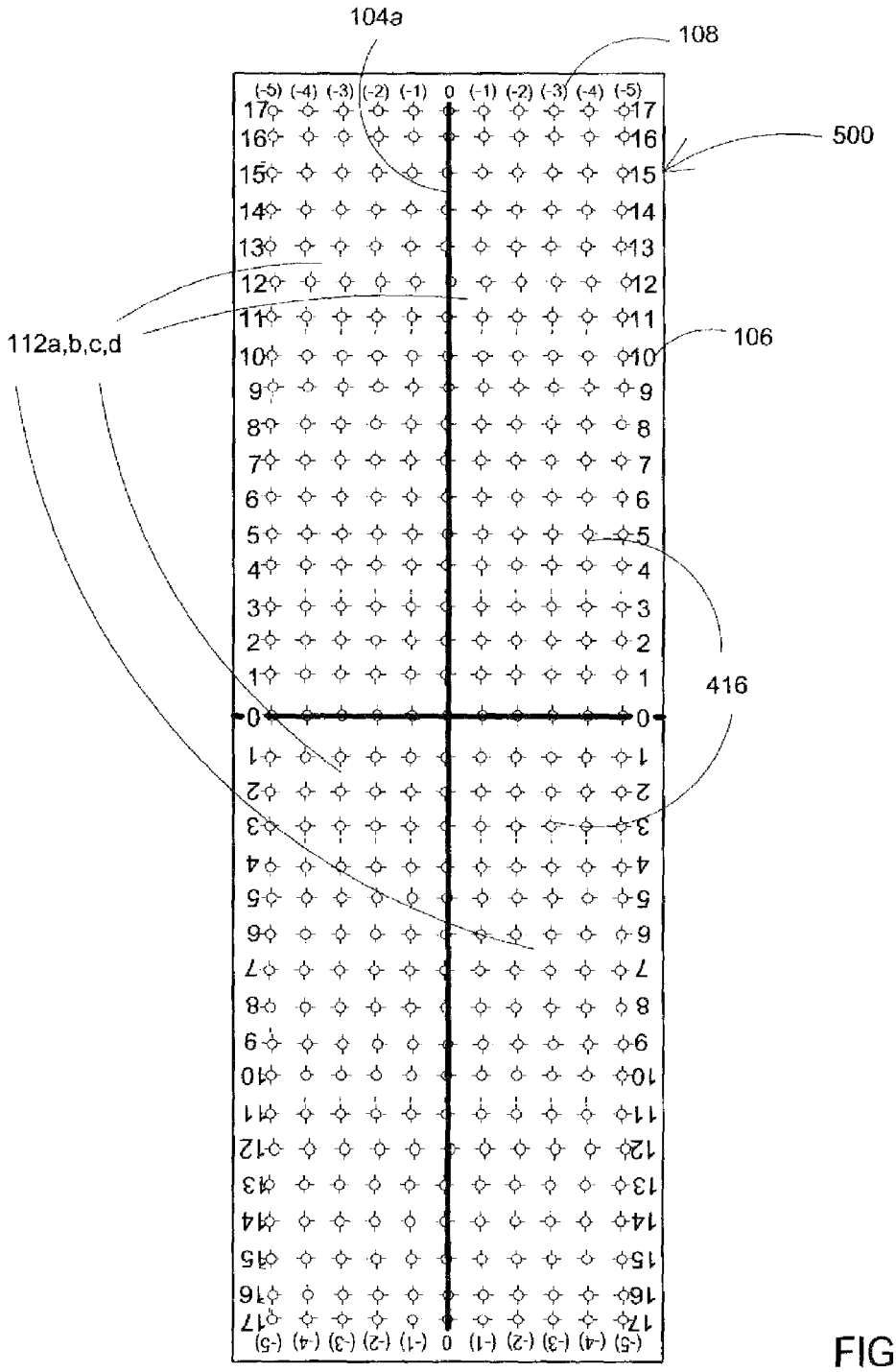
FIG. 5 is a view of an embodiment of the mat according to the present invention without the grid axis "500" design.
Figure 6:
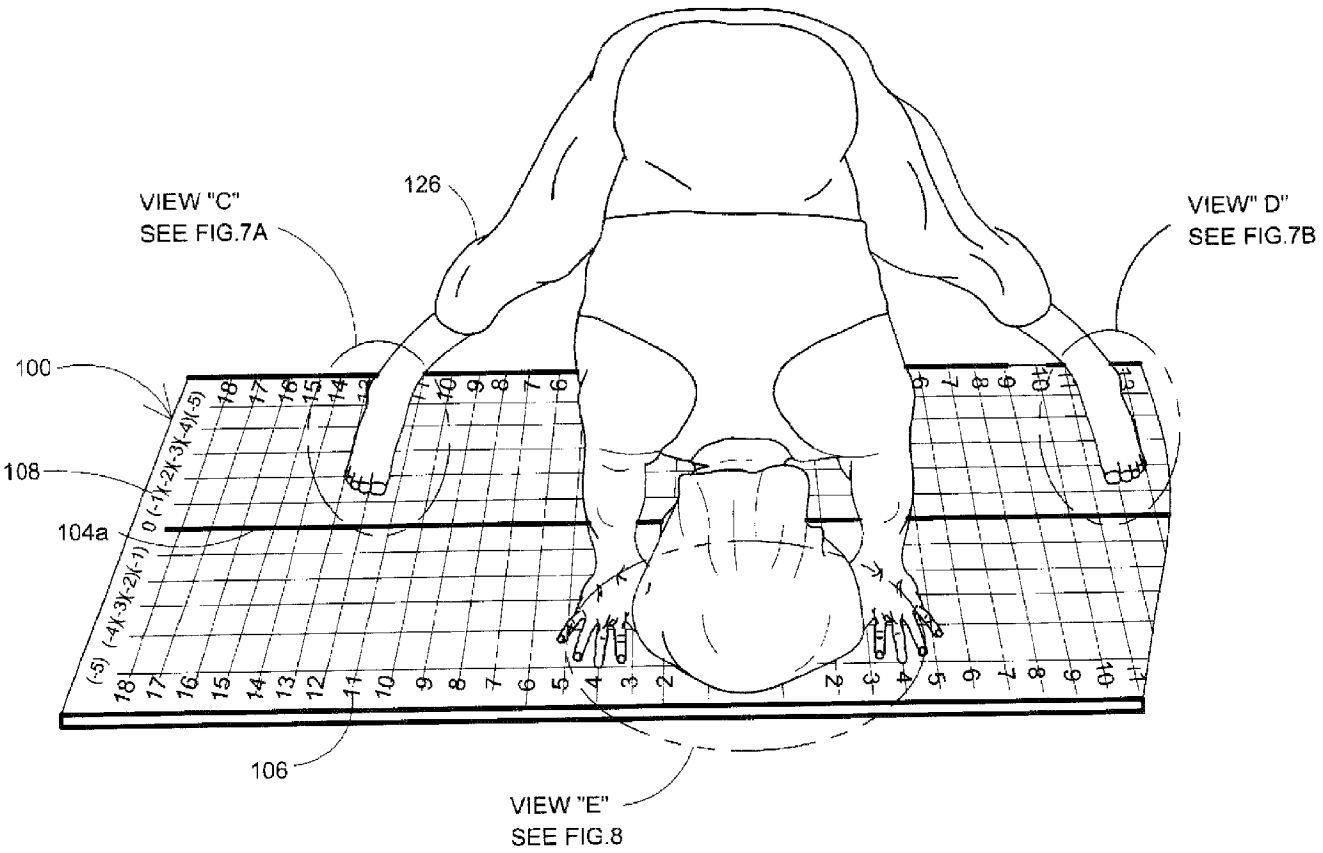
FIG. 6 is a view of mat 100 showing an environment of use with a person in a forward bend pose.
Figure 7A:
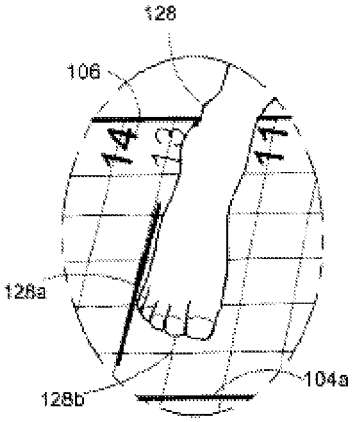
FIG. 7A is an enlarged view of section "C" of FIG. 6.
Figure 7B:
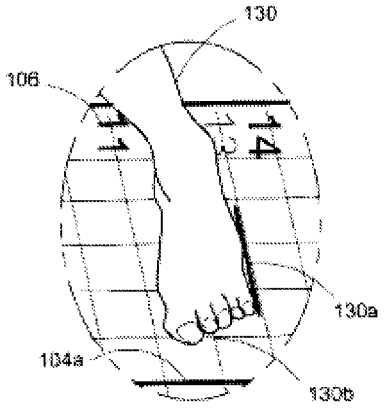
FIG. 7B is an enlarged view of section "D" of FIG. 6.
Figure 8:
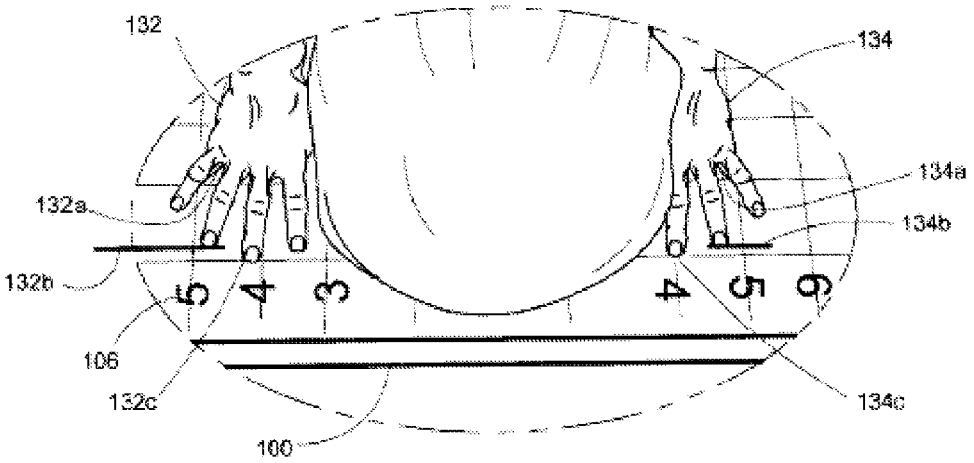
FIG. 8 is an enlarged view of section "E" of FIG. 6

As generally described herein the present invention includes a yoga mat and a method for performing and measuring yoga maneuvers utilizing said mat. It is to be understood that the accompanying figures are meant for illustrative purposes and are not intended to limit the present invention to the particular embodiments displayed thereon. For example, although the drawings show particular symbols denoting varying numbers, the invention relates to the general geography whereby the person's hands and/or feet are oriented and aligned on the yoga mat, and measurements from those points. In one embodiment, particularized grid markings can be used to connect spot measurement indicia. Additionally, the present invention encompasses a mat such as that shown in FIG. 5, wherein no particular grid lines are present but wherein indicia is provided for measurement during yoga exercises.

Figure 1A:
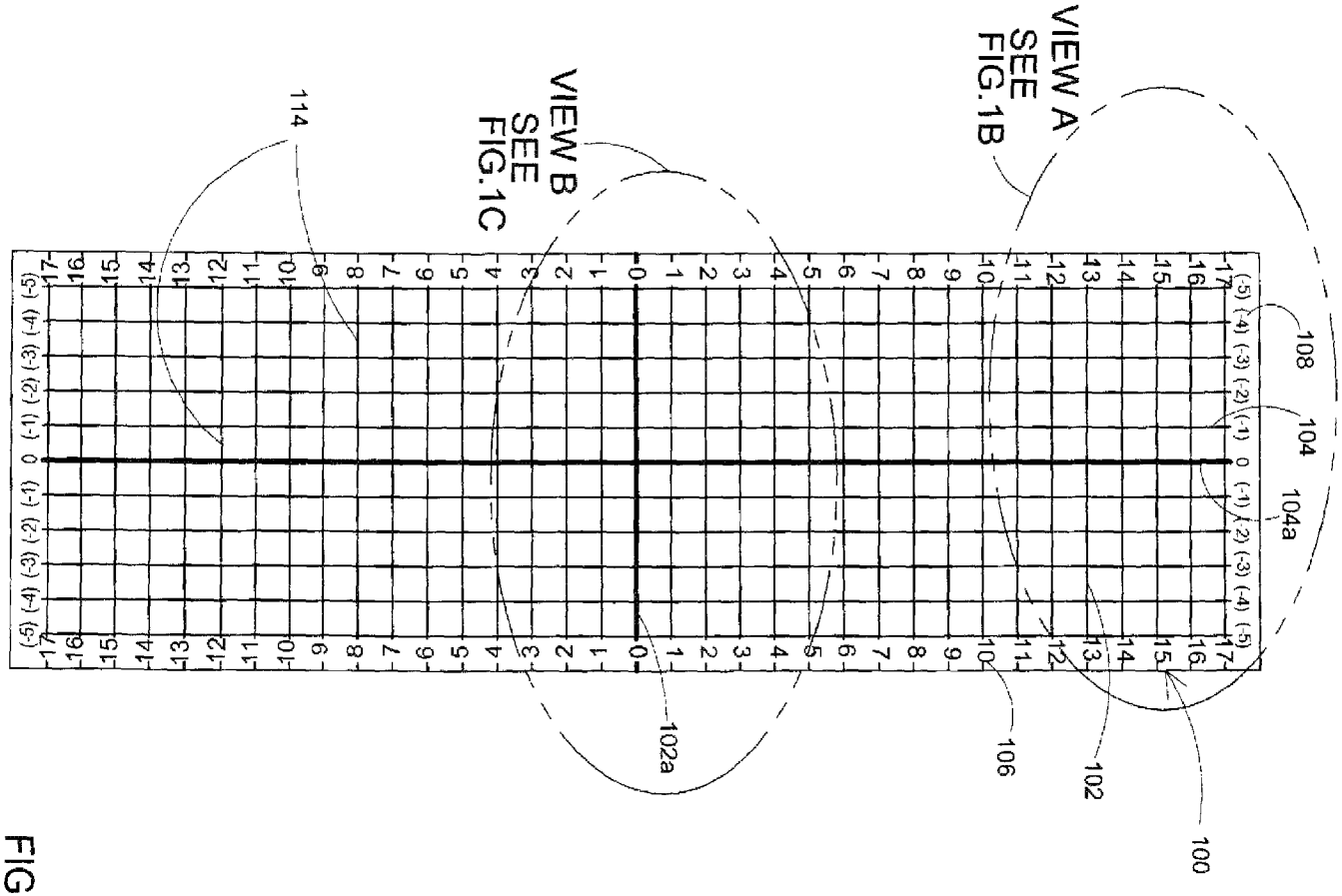
FIG. 1A is the view a mat according to the present invention with the "100th" design.
Figure 1B:
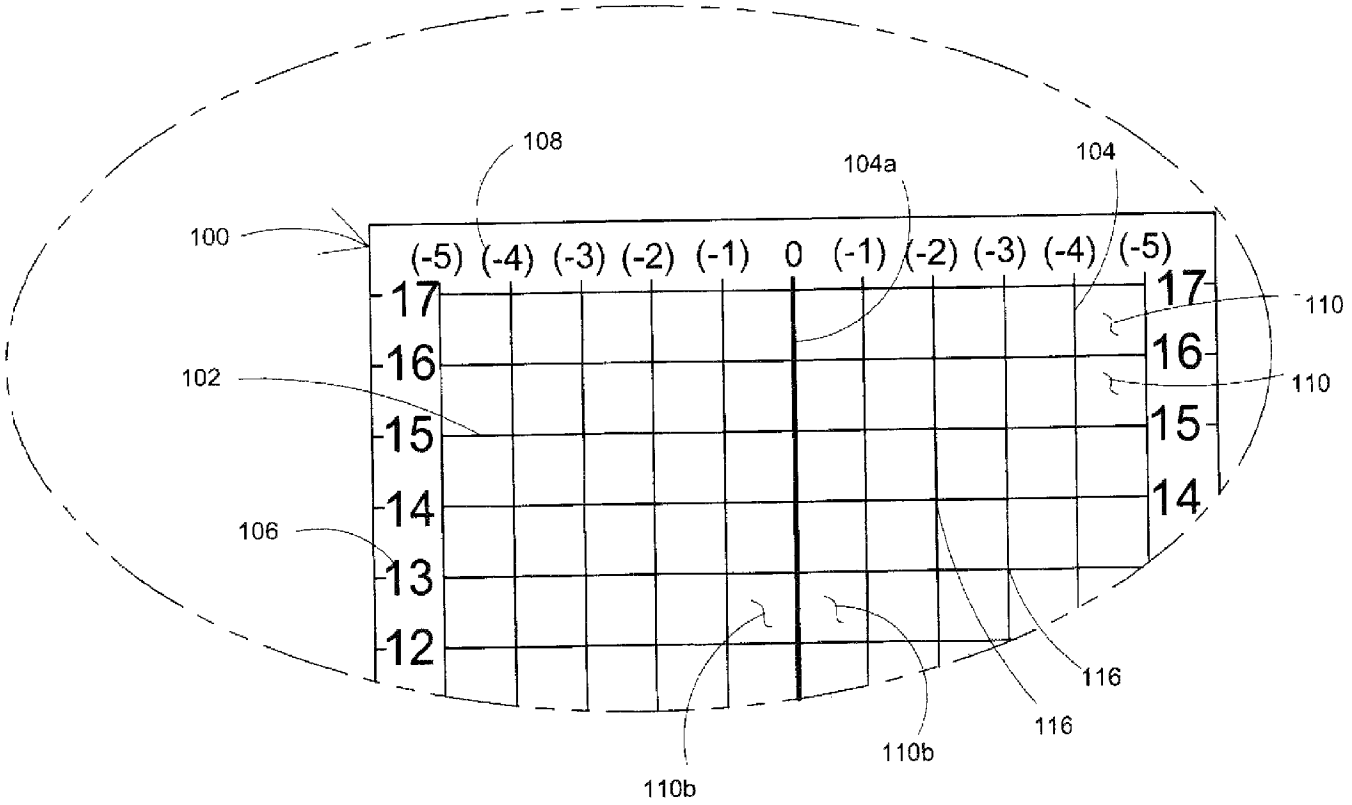
FIG. 1B is enlarged view from section "A" of FIG. 1A.
Figure 1C:
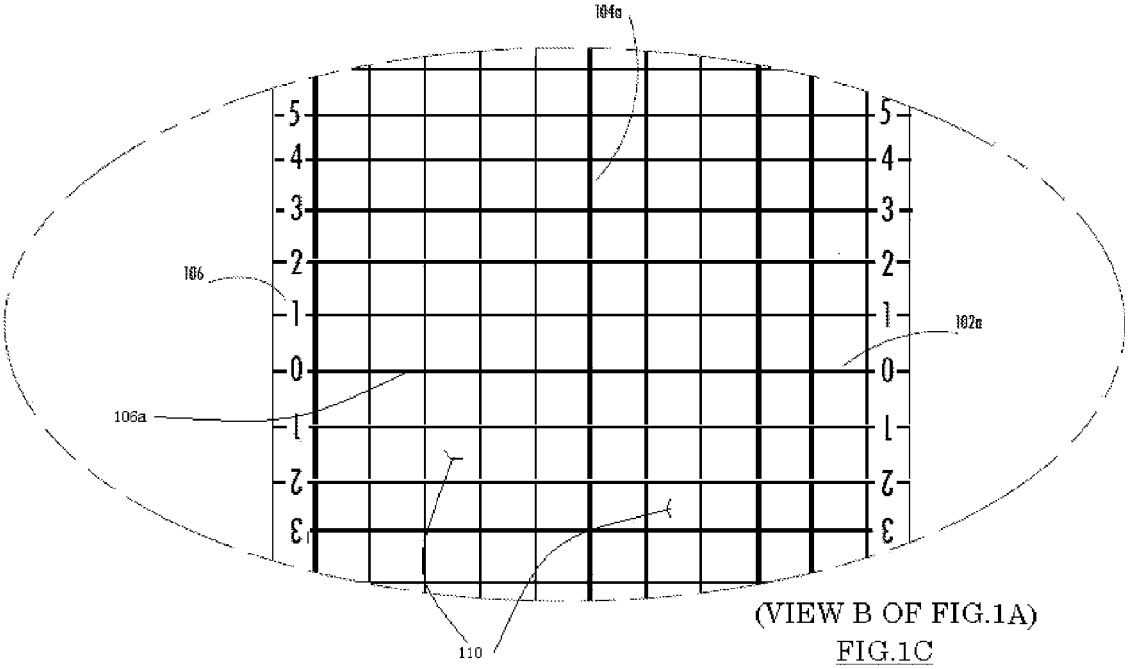
FIG. 1C is an enlarged view of section "B" of FIG. 1A.
Figure 2:
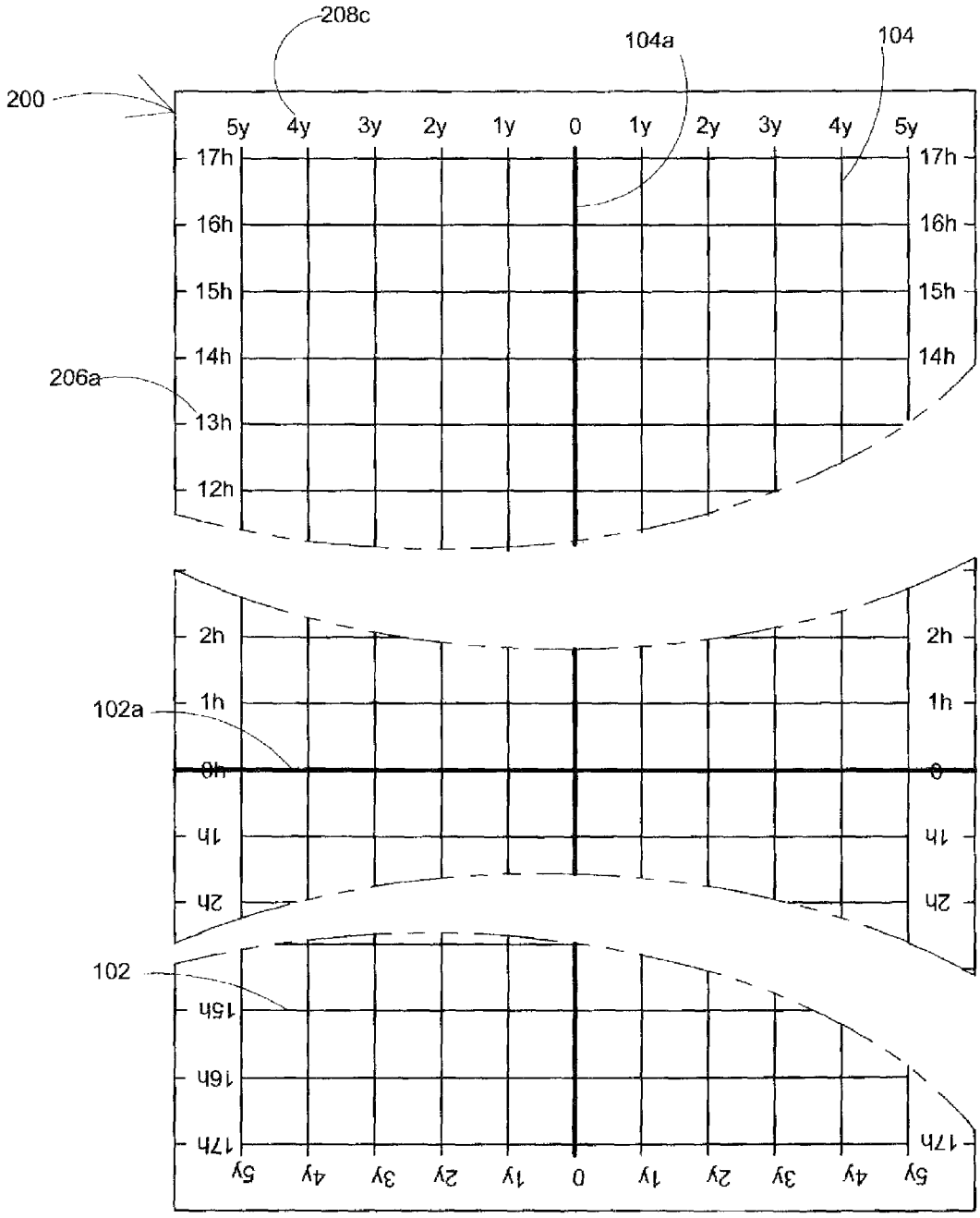
FIG. 2 is a view of the mat "200" using alternative indicia of the present invention with the "100" design.
Figure 3:
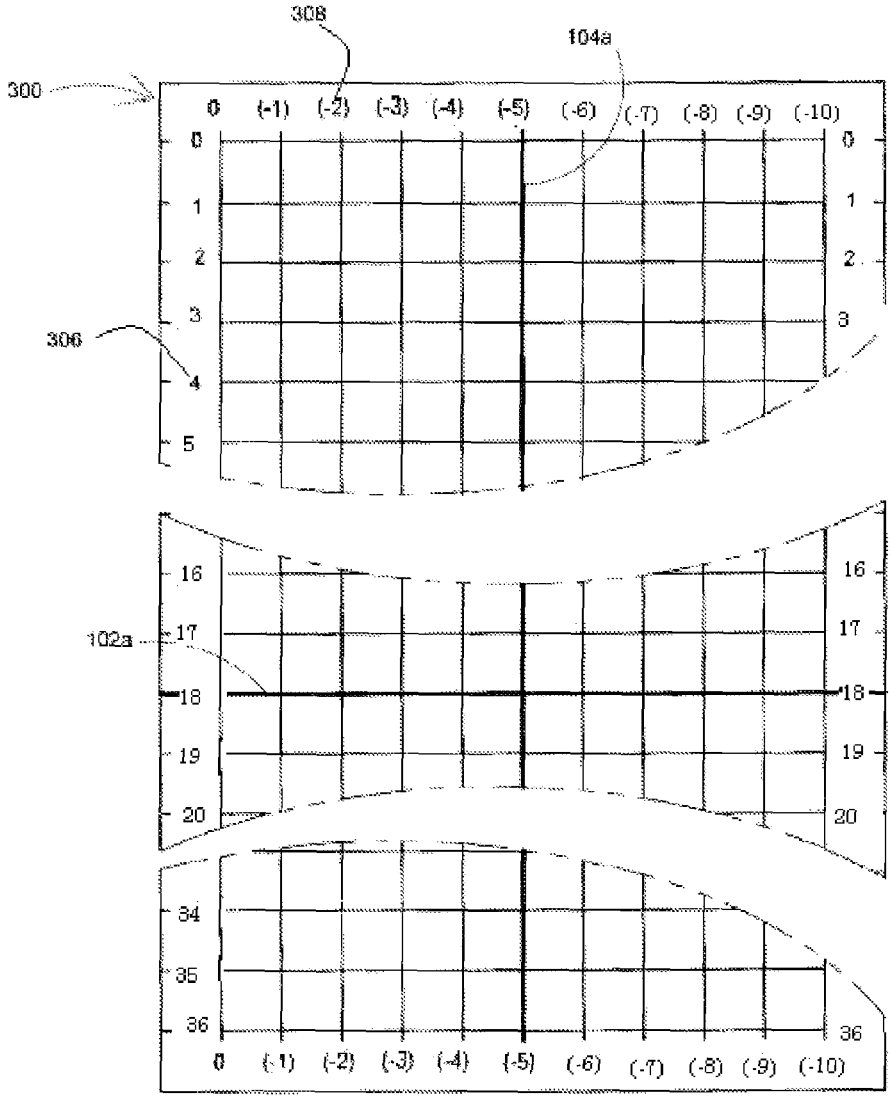
FIG. 3 is a view of an embodiment of the mat according to the present invention with the mat corner start non-symmetrical "300" design.

As shown in FIG. 1 Exercise Yoga mat 100 is provided with a generally planer surface printed with indicia. In one embodiment horizontal indicia 106 and vertical indicia 108 are printed on mat 100. In one embodiment, each of indicia 106 and 108 are sequentially numbered. Mat 100 is divided into two halves 110 and four equally sized quadrants 112. Each of two halves 110 of mat 100 are constructed and arranged in orientation such that one half of mat 110 is upside down with respect to the opposing half. Each of the two halves 110 of mat 100 includes two quadrants of mat 100 that are mirror images of one another. Yoga mat 100 in one embodiment is printed with equal distance horizontal indicia 106, legends 0-18 (2 inches apart for example) equal distance vertical indicia 108 legends 0-(−5) (2 inches apart). As previously discussed, each quadrant is substantially a mirror image of another. In one embodiment, horizontal indicia 106 and vertical indicia 108 printed on yoga mat 100 are spaced equally apart as desired. For example, indicia could be provided at one inch or two-inch intervals. Horizontal indicia 106 with connecting horizontal lines 102, and vertical indicia 108 with connecting vertical lines 104 provide a visual aid with numbered measurements to give the user a specific visual reference spot as to placement of body parts during yoga exercise poses.

Horizontal centerline 102*a* divides mat 100 into substantially into two horizontally equal halves.

Mat 100 additionally has vertical centerline 104A that divides mat 100 into substantially into two vertical halves.

Two equal horizontal halves 110*a* are preferably symmetrically placed with respect to horizontal centerline 102*a* forming mirror images of one another.

Two equal vertical halves 110*b* are preferably symmetrically placed with respect to vertical centerline 104*a* forming mirror images of one another.

In one embodiment four equal quadrants 112 are formed by printed indicia in which yoga mat 100 is divided into two equal horizontal halves 110*a* and two equal vertical halves 110*b*.

Each of the four equal quadrants 112*a*, 112*b* 112*c*, 112*d* are labeled in a similar pattern as defined by using horizontal indicia 106 and vertical indicia 108

These 4 quadrant identifying labels presume that the user is at the center on yoga mat 100 and has shoulders horizontally aligned so that 112*a* is at front left of users facing direction.

front left quadrant 112*a;* front right quadrant 112*b;* back left quadrant 112*c*; and back right quadrant 112*d*.

The final four equal quadrants 112 being symmetrically oriented in relation to horizontal center line 102(*a*) and vertical center line 104 (*a*)

In one embodiment, graph axis 114 is a uniform grid like pattern resulting from connecting horizontal lines 102 and connecting vertical lines 104 on yoga mat 100.

Coordinate measurement spots 116 are the spots on yoga mat 100 which are specific measured points on graph axis 114 resulting from where horizontal indicia 106 and vertical indicia 108 intersect. For example, a Coordinate measurement spot 116 will have intersecting spot of horizontal indicia 106, measurement 8, and vertical indicia 108, measurement (−3), to be Coordinate measurement spot 116, 8(−3), on Graph axis 114. 4(−4), 11(0), 0(−5), 17(−1) etc. can be other Coordinate measurement spots 116. Another example, where Horizontal centerline 102(*a*) and Vertical center line 104(*a*) intersect, will be labeled Coordinate measurement spot 116, 0(0).

Forward bend pose 126 is a yoga pose that the user or exerciser uses on yoga mat 100. Forward bend pose 126*a* requires the body to be positioned with the shoulders parallel with vertical indicia 108 on yoga mat 100. With this body/shoulder alignment along the vertical indicia 108, the quadrant in front right will now be 112*a*—will now be to the persons front right . . . as opposed to 112*a* being at the persons front left if one is aligned with shoulders parallel to horizontal indicia 106;

front right quadrant 112*b*—will now be to the persons back right;

back left quadrant 112*c*—will now be to the persons front left; and back right quadrant 112*d*—will now be to the persons back left.

Forward bend pose right foot 128 is a part of Forward bend pose 126 identifying the placement of the users right foot on Graph axis 114. Forward bend pose left foot 130 is a part of Forward bend pose 126 identifying the placement of the users left foot on Graph axis 114. Forward bend pose right hand 132 is a part of forward bend pose 126 identifying the placement of the user's right hand on Graph axis 114. Forward bend pose left hand 134 is a part of forward bend pose 126 identifying the placement of the user's left hand on graph axis 114.

The user practicing forward bend pose vertical 126 will then use graph axis 114 to align themselves properly with both hands and both feet. One then places each body contact point on the same horizontal plane and/or the same vertical plane and can easily measure distances. A user for instance will place Forward bend pose right foot 128 in quadrant 112*b* on Coordinate measurement spot 116 10(−1), and forward bend pose left foot 130 in quadrant 112*d* on Coordinate measurement spot 116, 10(−1). The user will then place Forward bend pose right hand 132 in quadrant 112*a* on Coordinate measurement spot 116 5(−2), and Forward bend pose left hand 134 in back left quadrant 112*c* on Coordinate measurement spot 116 5(−2), establishing the users body position in proper alignment and symmetry, and for quick measurement using the sum of the Coordinate measurement spots 116 from feet placement along the horizontal indicia 106 plane, and then also the sum of the Coordinate measurement spots 116 from hand placement along the horizontal indicia 106 plane.

In this example, assume the indicia on the mat are measured out at 1 inch from each other, the feet will result in being 20 inches apart, and the hands result in being 10 inches apart from each other.

Each embodiment disclosed herein is used either singularly or otherwise combined with any of the other embodiments disclosed. Any element of any embodiment will be used in any embodiment.

Embodiments include, for example, other labels that are used instead of numbers. For example, letters, a different alphabet and/or numbering system could be used; for example, Roman numerals could be used instead of the letters and/or numbers and the Greek alphabet, Hiragana alphabet, Sanskrit, the Mayan alphabet, various yoga symbols or signs, nature related symbols, colors, any symbols or signs, or another alphabet could be used instead of the English alphabet. The modification includes any indicia including numbers, letter, symbols and the like.

In certain embodiments, indicia will be spaced by an amount that is different than 1 or 2 inches apart, such as a distance between 1-4 inches, or fractional/decimal distances, (e.g., 1.5, 1.6, 1.7, 1.8, 1.9, 2.1, 2.2, 2.3, 2.4 or 2.5 inches/mm).

Mat 300 is constructed and arranged with measurement indicia start point in one of the mat corners, resulting in a sequential series along the mats perimeters with an assymetrical measuring method.

Figure 4:
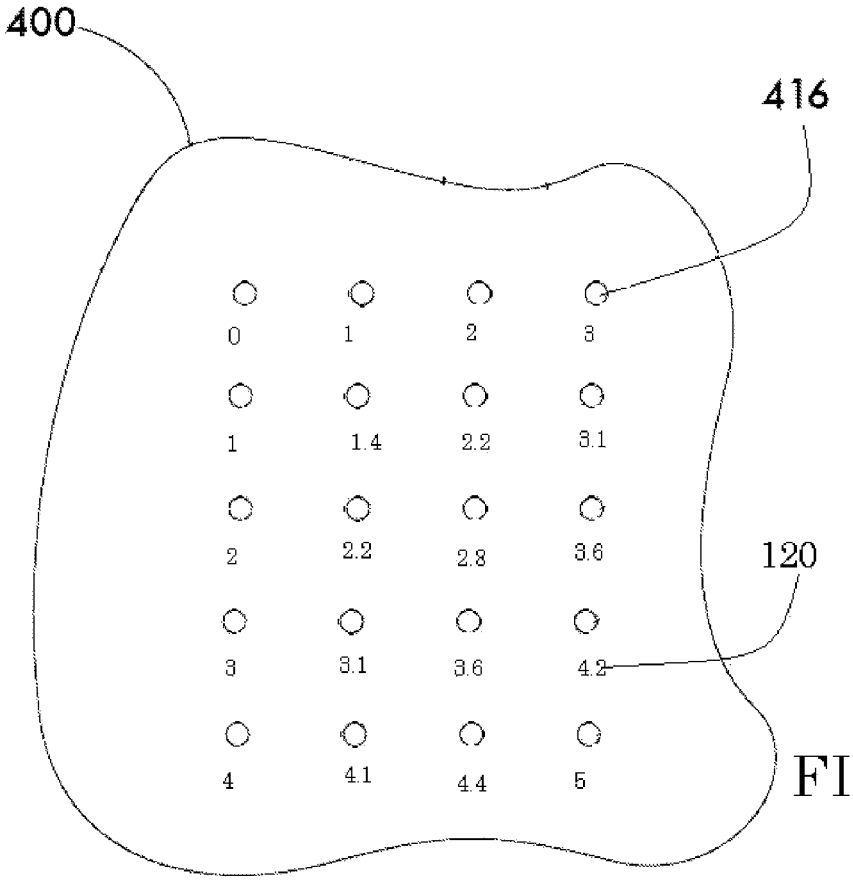
FIG. 4 is a partial view of an embodiment of the mat according to the present invention with linear indicia "400" design.

FIG. 4 is a partial view of an embodiment of the mat according to the present invention with a linear indicia "400" design. Mat 400 is constructed and arranged with a plurality of linear indicia 120 measurement spots 416 along horizontal and vertical planes illustrated a right angles. Measurement spots 416, in one embodiment are spaced equidistant one to another throughout mat 400. In another embodiment, spots 416 are spaced exponentially or gradated, meaning gradually larger or smaller in distance. As provided herein, spots 416 can also be color-coded to indicate any one or all of horizontal, vertical, or diagonal distance along mat 400. In the illustrated embodiment of FIG. 4, measurement spots 416 form an exemplary matrix four across and five down spaced equidistant one to another throughout mat 400. Each measurement spot 416 is depicted with number indicia printed on the mat. In the partial view embodiment of FIG. 4, the measurements spots in a first row across are numbered 0, 1, 2, and 3. In the partial view embodiment of FIG. 4, the measurements spots in a first column down across are numbered 0, 1, 2, 3, and 4. In the partial view embodiment of FIG. 4, the measurement spot numbered 0 is a single starting point. In the partial view embodiment of FIG. 4, the other measurement spots are decimals such as 1.4, 2.2, 3.1, 3.6, 4.2, 4.4, and 5. The number indicia corresponding to each of the measurement spots 416 illustrated in the partial view embodiment of FIG. 4 is the hypotenuse of a right-angled triangle which can be established using the known geometric Pythagorean theorem equation $a^2+b^2=c^2$, wherein the measurement spots in the first row across can be a, the measurements spots in the first column down can be b and the remaining measurement spots of the decimals can be c. Each decimal illustrated meets this Pythagorean theorem equation truncated to one decimal place. Therefore, the illustrated printed number indicia corresponding to each measurement spot 416 represents a linear distance along the surface of the yoga mat from that measurement spot to the single starting point 0.

Mat 500 is an embodiment where each spot 416 is related to indicia 106 and indicia 108 positioned along the perimeter of mat 500, but designed without horizontal lines 102 and vertical lines 104.

Any Exercise Yoga mat of the invention is contemplated constructed in many varieties, the material for Exercise Yoga mat 100,200,300,400,500 the numbers and letters sequencing, the space between the lines indicia, the thickness of the lines indicia, spot markings at each line indicia intersection, spot markings at center of each indicia, yoga mat 100,200,300,400,500 with a single graph axis direction, embroidered mat instead of printed, on a towel, on a device that can be attached or sealed or printed or taped on to any kind of Exercise Yoga mat, regardless of material thickness or general makeup of the Exercise Yoga mat, on floor in a gym, an item with measurements for exercise measurement and form, can be used for any sport that entails both body placement and/or form, (kickboxing, martial arts), round Exercise Yoga mats, various mat shapes, various mat sizes, thickness and shapes, diagonal lines, linear distances indicia 120, indicia commonly found on a ruler, equal graph lines indicia. The material used for the mat will be any flexible material, for example such as bamboo, rubber, foam, PVC, eco-friendly.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A method of performing exercises comprising:

(a) providing an exercise mat having an upper planar surface, a lower planar surface, and indicia displayed on the upper planar surface comprising a single starting point representing the number zero, a matrix of location indicia and two or more series of sequential integers counting outward from the single starting point constructed and arranged along a length or a width of the mat such that each location indicia on the upper planar surface corresponds to only one coordinate from the two or more series of sequential integers for placement of limbs on the exercise mat and to facilitate measurement of linear distances along the upper planar surface of said exercise mat;

(b) positioning a limb of a user on a point on said exercise mat;

(c) executing an exercise position by said user; and (d) measuring at least one distance of a user's limb relative to one or more of other user's limb or to other marked indicia on the mat.

2. The method of claim 1, wherein said indicia on the upper planar surface further comprises grid lines arranged and oriented from the single starting point and wherein said sequential integers are connected using the grid lines intersecting the location indicia.

3. The method of claim 1, wherein said location indicia include points equidistantly spaced from said single starting point.

4. A method of performing yoga exercises of claim 1, wherein the indicia further comprises a plurality of the one unique coordinate for each location indicia displayed on the upper planer surface.

5. A method of performing exercises comprising:

(a) providing an exercise mat having an upper planar surface, a lower planar surface, and indicia displayed on the upper planar surface comprising a single starting point centrally located at a center of the exercise mat representing the number zero, a matrix of location indicia and four or more series of sequential integers counting outward from the single starting point constructed and arranged along a length or a width of the mat such that each location indicia on the upper planar surface corresponds to only one coordinate from the four or more series of sequential integers for placement of limbs on the exercise mat and to facilitate measurement of linear distance the upper planar surface of said exercise mat;

(b) positioning a limb of a user on a first point on said exercise mat;

(c) executing an exercise position by said user; and (d) measuring at least one distance of a user's limb from the first point, a perpendicular point along a center horizontal midpoint line of the exercise mat, a perpendicular point along a vertical midpoint line of the exercise mat, or any combination thereof providing at least one of linear, horizontal, vertical measurements to a second point of at least one other of a user's limb when the at least one other limb is placed on the exercise mat.

6. The method of claim 5, wherein said indicia on the upper planar surface further comprises grid lines arranged and oriented from the single starting point and wherein said sequential integers are connected using the grid lines intersecting the location indicia.

7. The method of claim 5, wherein said exercise mat is divided into four quadrants relative to said centrally located starting point that are identically labeled with the sequential integers.

* * * * *